US008316938B2

(12) United States Patent
Al-Jarri et al.

(10) Patent No.: US 8,316,938 B2
(45) Date of Patent: Nov. 27, 2012

(54) SUBTERRANEAN WATER PRODUCTION, TRANSFER AND INJECTION METHOD AND APPARATUS

(75) Inventors: Abdulrahman S. Al-Jarri, Dhahran (SA); Abdullah S. Al-Muhaish, Dammam (SA); Elmetwaly Abelhamid Ibrahim, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 188 days.

(21) Appl. No.: 12/448,889

(22) PCT Filed: Feb. 13, 2008

(86) PCT No.: PCT/US2008/002005

§ 371 (c)(1), (2), (4) Date: Jan. 20, 2010

(87) PCT Pub. No.: WO2008/100592

PCT Pub. Date: Aug. 21, 2008

(65) Prior Publication Data

US 2010/0126721 A1 May 27, 2010

(51) Int. Cl.
*E21B 43/16* (2006.01)
*E21B 43/40* (2006.01)
*E21B 43/38* (2006.01)

(52) U.S. Cl. ..... 166/265; 166/106; 166/306; 166/369

(58) Field of Classification Search ..... 166/265, 166/306, 369, 372, 106
See application file for complete search history.

(56) References Cited

U.S. PATENT DOCUMENTS

| | | | |
|---|---|---|---|
| 1,661,270 | A | 3/1928 | Ryder et al. |
| 2,272,672 | A | 2/1942 | Kennedy |
| 2,347,779 | A | 5/1944 | Heath |
| 2,551,434 | A | 5/1951 | Gray et al. |
| 2,706,526 | A | 4/1955 | Van Den Beemt |
| 2,808,111 | A | 10/1957 | Krueger |
| 3,354,952 | A | 11/1967 | Engle |
| 3,627,048 | A | 12/1971 | Roeder |
| 4,009,756 | A | 3/1977 | Zehren |
| 4,766,957 | A | 8/1988 | McIntyre |
| 4,805,697 | A | 2/1989 | Fouillout et al. |
| 5,497,832 | A | 3/1996 | Stuebinger et al. |
| 6,299,781 | B1 | 10/2001 | Hanrahan |

OTHER PUBLICATIONS

International Search Report and Written Opinion, Jun. 19, 2008.

*Primary Examiner* — Giovanna Wright
(74) *Attorney, Agent, or Firm* — Abelman, Frayne & Schwab

(57) ABSTRACT

A method and apparatus is provided for diverting a ground water supply source located in a stratum that is hydraulically separated from a hydrocarbon-containing reservoir formation for injection into the reservoir proximate the oil-water interface to enhance the flow rate and production of the hydrocarbons through one or more well bores without pumping the injection water to the earth's surface. An electric submersible pump (ESP) and Y-tool assembly is positioned in the well bore at the level of the ground water supply and water is pumped down the well casing for injection into the formation, e.g., below the hydrocarbon-containing reservoir rock. Suitable seals, packers and cement plugs are provided to isolate the high pressure injection water from the ground water drawn into the first upper portion of the casing.

19 Claims, 2 Drawing Sheets

SUBTERRANEAN WATER PRODUCTION, TRANSFER AND INJECTION METHOD AND APPARATUS

FIELD OF THE INVENTION

This invention relates to the injection of water into reservoir rock formations in order to increase reservoir pressure and displace hydrocarbons fluids in them, thereby enhancing the production of hydrocarbon fluids into neighboring wells.

BACKGROUND OF THE INVENTION

As is well known to those familiar with the production of oil and other hydrocarbons from underground formations, it is often desirable to enhance the flow-rate of hydrocarbons into the well bore after an initial period of production by injecting water into the same reservoir strata to increase its pressure. It is also quite common for the well bore to pass through at least one underground stratum that produces water into the bore that is located at a considerable distance above the hydrocarbon-bearing strata. These water-bearing strata can be isolated by mechanical seals or packers, or by cementing so that water does not find its way into the produced hydrocarbon stream that is typically produced from the bottom of the well bore.

In accordance with current water injection practices, water produced in the well bore or from other well sites is pumped to the surface and fed to the intake of high pressure pumps. Depending on the volume/flow-rate of available water, it may have to be accumulated before delivery to the pumping facility. The discharge from these high pressure pumps is then delivered, often over long distances, e.g., 25 to 30 kilometers, through high-pressure pipes ranging in size from 24 inches to 30 inches in diameter. It will be understood that the capital costs and expenses associated with the construction and operation of this infrastructure for a water injection system that services an oil field stretching over many hundreds or even thousands of square kilometers is substantial. From the above brief description of the prior art methods of providing pressurized water for injection into subterranean formations to enhance hydrocarbon production, the desirability of utilizing an apparatus and method in which this infrastructure is unnecessary is apparent.

It is therefore an objective of this invention to provide a method and apparatus that eliminates the necessity of constructing extensive low and high pressure pipeline systems and pumping stations at the earth's surface in order to deliver pressurized injection water.

It is a further objective of the invention to minimize the distance and, therefore, the associated energy requirements, over which water must be transported from its point of production to the location of its injection into the reservoir formation.

An additional objective of the invention is to provide an apparatus and method for employing an electric submersible pump ("ESP") injection system that is protected from damage by sand and particulate matter carried by the produced formation water and which minimizes rigging time and costs during installation and retrieval of the completion.

Another objective of the invention is to provide a specifically configured, stand-alone apparatus and a novel method for delivering water from an upper formation zone to a lower formation zone that will permit retrieval and replacement of portions of the completion and will also allow access to the injection zone for logging and well intervention operations without removal of the sand exclusion screens completion.

SUMMARY OF THE INVENTION

The above objects and other advantages are achieved with the practice of the method and apparatus of the present invention which broadly comprehends admitting water into the casing from a water producing stratum through which the well bore passes; collecting the water in a portion of the casing; pressurizing the water, e.g., using a removable pump that is fixedly positioned inside the casing at the location where the water is admitted; directing the pressurized pump output stream to a lower portion of the casing; discharging the pressurized water into a hydrocarbon-free stratum, preferably a water bearing satum, to produce a zone of increased water pressure to thereby enhance the flow of hydrocarbons into one or more well bores for production of the hydrocarbons to the earth's surface.

As well be understood by one of ordinary skill in the art, the water injection is typically into a stratum below the oil-bearing stratum. However, formation conditions may permit water injection into a stratum that includes barrier layers or other structural conditions that permit the pressurized water to act from above the oil-bearing stratum.

It is also known in pressurizing a field containing a number of adjacent well bores, that the well through which the injected water is introduced to increase the flow of hydrocarbons is not itself employed in producing hydrocarbon fluids to the surface. Rather, the enhanced hydrocarbon flow is received by one or more adjacent production wells in the field from which the flow is delivered to the surface. In one embodiment, the present invention can be employed to receive the injected water-enhanced hydrocarbon flow into the same casing from which the injected water is discharged. In that embodiment, the well bore is isolated from the water stratum by cement or other conventional means and the casing is perforated between the upper water-admitting section and the lower water discharge section to admit the hydrocarbon flow into a third section which is isolated from the other two casing sections. In this embodiment, the produced hydrocarbons are conveyed by production tubing, either by the force of the reservoir pressure or by a down hole pump or other conventional means.

The method and use of the invention for enhancing the recovery of hydrocarbons from a hydrocarbon bearing stratum in a subterranean reservoir supply formation through a production tubing string that is positioned in a casing located in a well bore, comprising the steps of:

a. providing the casing with an upper and a lower isolation assembly to define a first portion of the well casing;
b. admitting water into the first portion of the well casing from a first water-containing stratum in the reservoir that is located above the hydrocarbon-bearing stratum;
c. pumping pressurized water from the first portion of the casing through a vertically-mounted electrical submersible pump ("ESP") that is attached to one leg of a Y-tool;
d. discharging the pressurized water into a conduit attached to a second leg of the Y-tool, the conduit passing through the lower isolation assembly of the first portion of the casing;
e. discharging the water from the second portion of the well casing into a second stratum of the reservoir surrounding the well bore at a position that is proximate the hydrocarbons contained in the reservoir, whereby the water discharged into the second stratum enhances the flow of any hydrocarbons from the reservoir above the second water-containing stratum into either separate hydrocarbon production well bores or into an oil production tubing in the same well bore.

As will be apparent to those of ordinary skill in the art, this method is applicable for use in those formations where the well bore passes through one or more water-producing strata that are located above the point in the formation at which water is to be injected to enhance hydrocarbon flow. In those formations where an oil/water interface exists, the source of high pressure water for injection must be in a stratum that is separate from that in which the oil/water interface exists.

In a conventional completion, ESP's are run on the bottom of the completion string and it is therefore not possible to gain access below the ESP without first pulling the completion. It is known in the art to provide an ESP by-pass system that allows the wellbore below the ESP to be accessed. This is accomplished by attaching the ESP to one side of a Y-tool, or Y-block. This arrangement makes it possible to pass the ESP to carry out logging operations, set bridge plugs, perforate piping, and to run wireline and coiled tubing without pulling the completion. Various devices and methods are also known in the art for isolating the pump side of the ESP/Y-tool assembly to allow upward flow through a by-pass tubing. It is also known to completely isolate the ESP from the production string, which may be desirable during chemical injection, acidising and other operations, or where the well is free-flowing and the ESP is not required. However, the art does not disclose any combination of an ESP with other apparatus for pumping produced water entering the wellbore at an upper portion of the formation into an injection zone in a lower portion of the formation.

The apparatus utilized in the invention includes an electric submersible pump that is installed with its discharge directed upwardly in the vertical direction. The output of the ESP is attached to a Y-tool or other functionally comparable Y-shaped fitting that is installed in the casing. This assembly of the ESP and Y-tool is positioned in the casing and isolated with appropriate seals and/or packers to define a first portion of the casing, so that the intake of the ESP receives the water produced from a first zone that is a water-producing or water-bearing stratum of the formation.

As used herein the term Y-tool is intended to include commercially available devices that are sold by oil field equipment suppliers, as well as custom fabricated devices that are structurally and/or functionally equivalent to Y-tools.

In a preferred embodiment, sand screens or filters are permanently installed in this first portion where the casing is perforated to minimize solids passing through the pump and associated fittings and piping. The screens or filter assembly are separate and apart from the ESP and Y-tool assembly, so that the filter assembly can be left in place if the other components must be removed for servicing or to permit the insertion of other tools through the casing at the upper zone.

The filter assembly is provided with seals above and below the perforations and its central axial portion is open to receive one or more conduits aligned with the casing axis.

The upper end of the Y-tool is capped or otherwise sealed so that the pressurized water exiting the ESP in an upward direction is directed downwardly for discharge into the second portion of the casing. As noted above, the Y-tool assembly is isolated with appropriate seals and/or packers so that the pressure is maintained downstream of the discharge end of the assembly.

Thus, the apparatus of the invention broadly comprehends the installation of sand exclusion screens across the water production zone in the upper part of the formation, the installation of a Y-tool to which is connected the ESP by means of a pump sub. A closed nipple, or plug, is installed in the top of the Y-tool to prevent pressurized water from flowing to the surface. A string of injection tubing is connected to the lower end of the Y-tool and passes through appropriate packer seals that isolate the water production zone from the lower injection zone. The injection zone is likewise isolated with a packer from the hydrocarbon-producing zone that is in a preferred embodiment above the injection zone.

In a particularly preferred embodiment, a check valve is installed to run above the ESP to prevent backflow when the ESP is shut down. Backflow through the ESP is potentially damaging, since it causes the ESP to rotate in reverse. A further preferred embodiment includes the installation of a packer above the Y-tool to minimize vibration of the ESP which is suspended from one branch of the Y-tool.

The method and apparatus of the invention have a number of advantages, including the cost-savings associated with the elimination of surface facilities for handling the injection water and the construction of a network of water pipelines. The present system also enhances safety by avoiding high pressure water pipelines, valves and pumps at the surface.

The apparatus of the invention is relatively easy to extend to wells as the need arises for water injection to enhance hydrocarbon production. The design and construction of the assembly uses conventional and readily available components and is also comparatively easy to work over. Use of the invention also reduces the exposure of the casing to stagnant water and will therefore reduce corrosion problems and associated maintenance costs.

The balance from the hydrocarbon reservoir is achieved by distributing the water injection wells in accordance with techniques that are well known to those of ordinary skill in the art.

BRIEF DESCRIPTION OF THE DRAWINGS

The method and apparatus of the invention will be described in further detail below and with reference to the attached drawings in which like or similar elements are referred to by the same number, and where.

DETAILED DESCRIPTION OF A PREFERRED EMBODIMENT OF THE INVENTION

Figure 1:
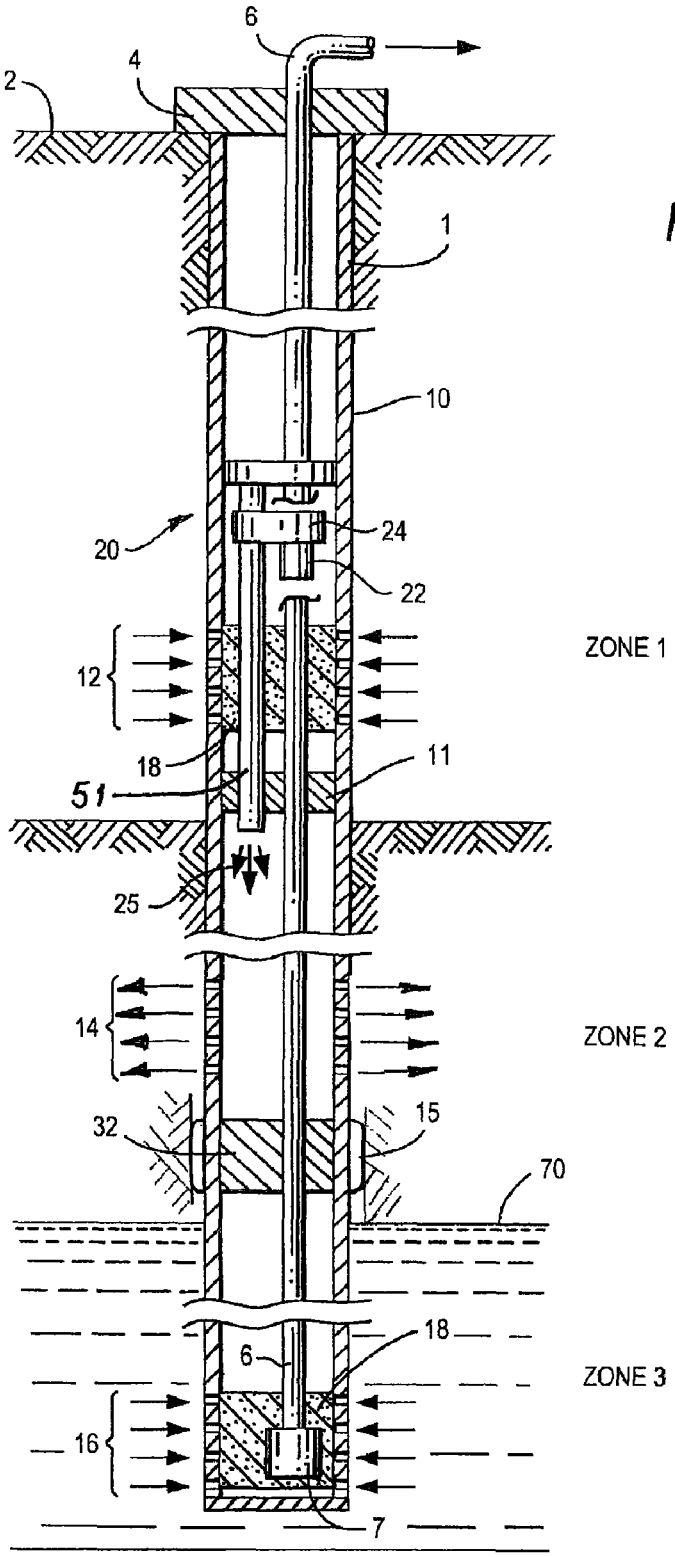
FIG. 1 is a schematic vertical cross-sectional view of a portion of the earth's surface penetrated by a well bore containing apparatus for practicing the method of the invention.

With reference to FIG. 1, there is schematically illustrated a vertical well bore 1 extending from the earth's surface 2 through various strata of the earth including a first water producing Zone 1, a lower injection stratum identified as Zone 2, and then into a reservoir rock formation that is generally identified as Zone 3. The upper boundary layer of Zone 3 is a water-oil interface 70.

The well bore 1 is lined with a casing string 10 consisting of a plurality of pipes that are joined to form the string. The casing string 10 can be formed of pipes of the same diameter or of diameters that decrease with depth, as will be further discussed in connection with the description of FIG. 2, below.

A hydrocarbon production tubing string 6 extends from the bottom of the well bore in Zone 3 up to, and through well cap 4. Production tubing string 6 can be provided with one or more pumps 7 to lift the produced hydrocarbons to the surface.

With continuing reference to the schematic illustration of FIG. 1, well bore 1 passes through Zone 1 which includes a water-bearing strata. In order to prevent water from descending through the annulus formed by the well bore walls and casing 10, a cement plug 11, or other mechanical dam means, is used to fill the annular region below the water-producing stratum.

Casing 10 is provided with a plurality of perforations 12 to admit water into its interior in Zone 1. This portion of casing 10 is also fitted with a filter assembly, including sand screens 18, to prevent or minimize the entry of particulate matter into this portion of the casing.

The casing is also fitted with an assembly 20, comprising electric submersible pump 22 and Y-tool 24 and is isolated in this first portion by seals and/or packers, to enable the pump 22 to draw the produced water through its intake and pass the pressurized stream vertically through the discharge into one leg of the Y-tool 24 and through conduits, schematically depicted at 51, for discharge at 25. The pressurized stream of water discharged at 25 fills the downstream second portion of casing 10 where it encounters a packer 32 surrounding production tube 6. Likewise, the annular space between the outside of casing 10 and well bore 1 at this position is filled with cement 15, or otherwise sealed to prevent a downhole flow of water. The pressurized stream is injected through perforations 14 into Zone 2 of the reservoir formation above the oil/water interface 70. As the injected water pressure builds in Zone 2, the effect is to lower the interface 70 while applying additional pressure to the hydrocarbons in Zone 3, thereby causing the hydrocarbons to move to the relative low pressure region at the lower end of well bore 1. The moving hydrocarbons enter the lower end of casing 10 through a plurality of perforations 16 which are preferably fitted with an internal screen 18 to minimize the intake of solid particulate matter with the produced hydrocarbons.

Figure 2:
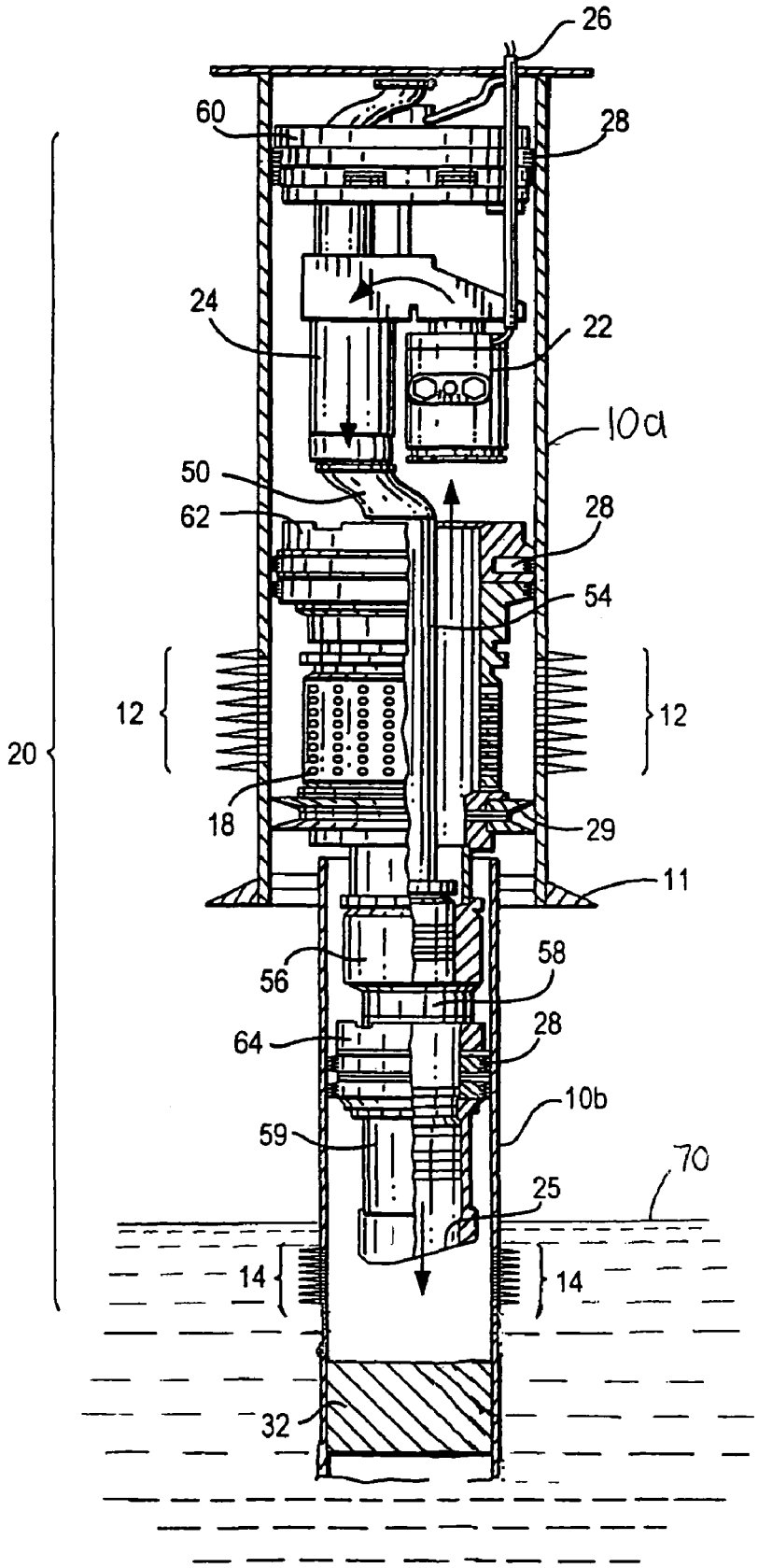
FIG. 2 is a side elevational view, partly in section, of a well casing fitted with the ESP and Y-tool assembly of the invention.

Other apparatus configurations include extending conduit 51 through another packer 11 (not shown) located downhole which serves to define a second portion of the casing provided with perforations 14. As will be described in more detailed in FIG. 2, perforation 14 can be located below the hydrocarbon-bearing stratum in a water-bearing stratum in order to enhance the flow of hydrocarbons:

Referring now to the enlarged vertical elevation view of FIG. 2, this embodiment illustrates the installation of the apparatus in a first and second section of casing 10*a* and 10*b*, where the lower casing is of a smaller diameter. As will be understood by one of ordinary skill in the art, the invention can also be practiced with the assembly installed in a casing of uniform diameter as schematically shown in FIG. 1. The effects of different pipe diameters is in the selection and size of the various seals, identified generally as 28, volumetric flow rates and injection pressure calculations, all of which are within the skill of the art.

The principal elements are as described above, being the ESP 22 attached to the Y-tool 24 and forming parts of assembly 20, along with related fittings and conduits. A power cable 26 extends from the surface to ESP 22.

Water entering through perforations 12 in upper casing section 10*a* passes through filter assembly 18 and is retained in a chamber formed by ESP packer 60 and the packer 29, and by seals inside seal bore receptacle 56. As shown by the arrow, pressurized water is discharged from the upper end of ESP 22 and enters the Y-tool 24 in a downflow direction. Various other fittings and pipes making up the illustrative assembly of FIG. 2 include landing nipple 50 and shear sub at the isolation seal assembly in 56. The remaining fittings in this set-up include a snap latch assembly 58 to seal the inside the seal base and a seal bore extension 59 and latch into packer 64. Additional seals include the large diameter retrievable seal 62 positioned above screen filters 18 and the lower retrievable seal bore packer 64.

In a further preferred embodiment, an additional packer is installed above the Y-tool to support the ESP and reduce any vibrational effects and also to isolate the annular space above the packer from the potentially corrosive effects of fluids from the water-bearing stratum.

This configuration of the apparatus has the important advantage of operating the ESP in its vertically upright position, rather than an inverted position with the discharge from the bottom. This choice of orientation is important because the stress forces imposed upon the ESP during operation in an inverted position will effect its operationally useful lifetime. As configured in the present invention, the ESP is running in its normal upright operational mode and possible stress failures are thereby avoided. This location above the production perforations allows any solids to settle below the ESP, thereby reducing the risk of having the ESP stuck in the hole during extended operations.

The apparatus of the invention also has the advantages of providing access to the injection zone without removing completion components in the event that logging or well intervention is required after installation of the assembly. A further advantage includes the capability of retrieving the ESP and associated tubing for repair/maintenance of the pump without removing the screen of filter assembly 18 and any completion accessories that have been installed.

The assembly 20 can include an injection string that consists of various sizes of short by-pass tubing 59 to reduce frictional loses in the pressurized stream. A packer 64 is provided to isolate the water production zone Z1 and injection zone Z2, while another packer 60 above the Y-tool unit 24 serves to minimize the effects of flow vibration on the ESP. The hydrocarbon-bearing reservoir of zone Z3 is isolated by a packer 32 from injection zone Z2.

In a preferred embodiment, a check valve (not specifically shown) is installed above the ESP to avoid backflow when the pump is turned off. This is desirable, since backflow will cause the ESP unit to rotate in a reverse direction, which can potentially damage internal bearings. A further particular advantage to this configuration is the ability to access the injection zone with logging tools and well intervention operations without the necessity of removing the sand exclusion screens of filter assembly 18.

As will be apparent to one of ordinary skill in the art, the apparatus can be scaled up or down, depending upon the required water injection flow rates and pressure by selection of casing diameter, pump capacity and components to provide those that are designed to meet the specific requirements present in the field installation. The selection of the pump and related components is well within the skill of the art.

As will also be apparent to one of ordinary skill in the art, various other arrangements and components can be used in the construction of the overall assembly without departing from the function aspects and purpose of the invention, the scope of which is to be determined by reference to the claims that follow.

We claim:

1. A method of injecting water into a geological reservoir formation containing hydrocarbons in order to enhance the flow of hydrocarbons into one or more casings positioned in well bores in the reservoir, the method comprising:

a. providing a casing with an upper and a lower isolation assembly to define a first portion of the well casing;

b. admitting water into the first portion of the well casing from a first water-containing stratum in the reservoir;

c. pumping pressurized water from the first portion of the casing through a vertically-mounted electric submersible pump (ESP) that is attached to one leg of a Y-tool;

d. discharging the pressurized water from a second leg of the Y-tool into an injection conduit, the conduit passing through the lower isolation assembly of the first portion of the casing;

e. discharging pressurized water from the injection conduit into a lower second portion of the well casing that is defined by a second isolation assembly; and f. injecting the water from the second portion of the well casing into a second stratum of the reservoir surrounding the well bore at a position proximate the hydrocarbons contained in the reservoir formation, whereby the water discharged into the second stratum enhances the flow of any hydrocarbons from the reservoir into the casing in the well bore.

2. The method of claim 1 which includes the step of passing the water admitted to the first portion of casing through a filter assembly to remove particulate matter from water entering the pump.

3. The method of claim 2 in which the ESP is positioned above of the filter assembly.

4. The method of claim 1 which further includes isolating the first portion of casing with a first seal bore packer and a second seal bore packer.

5. The method of claim 1, wherein a retrievable seal bore packer is installed in the lower second portion of the well casing to isolate the first water-containing stratum from the second stratum of the reservoir surrounding the well bore at a position proximate the hydrocarbons contained in the reservoir formation.

6. The method of claim 1, the first portion of casing having a first diameter, and the second portion of casing having a second diameter, wherein the diameter of the first portion of casing is greater than the diameter of the second portion of casing.

7. The method of claim 1 in which the first stratum is hydraulically isolated from the second stratum.

8. The method of claim 1 in which the first and second reservoir strata are above a hydrocarbon-containing stratum.

9. The method of claim 8 in which hydrocarbons enter a third portion of the casing that is isolated from the first and second portions and are collected and delivered to the earth's surface through a production tubing string opening located in the third portion of the casing.

10. The method of claim 9 which further includes installing a production tubing string through the upper and lower isolation assemblies in the first portion of the casing.

11. The method of claim 1, wherein in step (e), the discharged pressurized water is delivered to the second portion of casing at a predetermined pressure.

12. A method of enhancing the recovery of hydrocarbons from a hydrocarbon-containing subterranean reservoir formation through one or more well bores, the method comprising:

a. producing water from a first zone located above a hydrocarbon-containing stratum of the reservoir into an isolated first portion of a casing in the well bore;

b. pumping water from the first portion through an electric submersible pump (ESP) in fluid communication with a Y-tool and injection conduit that is installed in the first portion of the casing;

c. discharging pressurized water from the injection conduit into an isolated second portion of the casing; and d. injecting the pressurized water from the second portion of the casing into the reservoir formation at a second zone that is located above a third zone that is the hydrocarbon-containing stratum, whereby the pressure of the water injected into the second zone increases the flow of hydrocarbons from the third zone into the one or more well bores for recovery.

13. The method of claim 12 which further comprises:

isolating the water produced from the first zone from the portion of the casing above the first zone and from the second zone; and isolating the portion of the casing proximate the second zone from the portion of the casing that is proximate the third zone.

14. In the method of enhancing the production of hydrocarbons from a subterranean reservoir rock formation by injecting water into the formation below the hydrocarbon-containing reservoir by drawing water from a first stratum that is located above, and remote from the hydrocarbon-containing reservoir and where the water is plentiful, and pumping it into a second stratum that is separate from, and contiguous with the hydrocarbon-containing reservoir rock to increase the pressure on the hydrocarbons to thereby cause the hydrocarbons to flow to a well bore passing through the reservoir, the improvement characterized by:

a. installing an electric submersible pump (ESP) having a discharge outlet attached to a Y-tool and injection conduit positioned in a first isolated portion of a well casing that is in fluid communication with the first water-producing stratum of the reservoir;

b. admitting water from the first stratum into the first portion of the casing;

c. pumping pressurized water directly from the ESP through the Y-tool conduit in a direction that is aligned with the longitudinal axis of the casing to a second lower isolated portion of the casing that is in fluid communication with the second stratum; and d. injecting the pressurized water into the second stratum.

15. The method of claim 14, wherein the pumping occurs at the level of the first stratum.

16. The method of claim 14 which includes filtering the water admitted into the first portion of the casing.

17. Apparatus for delivering a pressurized stream of water for injection into a hydrocarbon-containing reservoir rock formation to enhance the flow of hydrocarbons into a well bore for production to the earth's surface, where the injection water emanates as ground water from an upper subterranean stratum through which the well bore passes, the apparatus comprising:

a. an electric submersible pump (ESP) positioned in a first portion of well casing located in the wellbore, the first portion of casing isolated from a hydrocarbon- producing stratum of the reservoir rock formation, the ESP being positioned to discharge a stream of pressurized ground water vertically and a Y-tool in fluid communication with the ESP, whereby the direction of the stream of pressurized water from the ESP is discharged in a downhole direction from the Y-tool into a second portion of casing located below the first portion of casing for injection into the reservoir to enhance the flow of hydrocarbons into a third portion of casing located below the second portion of the casing and isolated from the first and second portions of the casing;

b. isolation means defining the first portion of casing, and for receiving electrical conduits connected to the ESP and fluid conduits carrying the stream of pressurized water; and c. sealing means for isolating and defining the second portion of casing through which pressurized water is injected into the reservoir.

18. The apparatus of claim 17 in which the isolation means include seals to isolate the ESP and its intake from the higher pressure injection water discharged from the Y-tool.

19. The apparatus of claim 17 which further includes filters to remove particles from the ground water drawn into the ESP.

* * * * *

UNITED STATES PATENT AND TRADEMARK OFFICE

CERTIFICATE OF CORRECTION

PATENT NO. : 8,316,938 B2
APPLICATION NO. : 12/448889
DATED : November 27, 2012
INVENTOR(S) : Al-Jarri It is certified that error appears in the above-identified patent and that said Letters Patent is hereby corrected as shown below:

For the third inventor, correct "Elmetwaly Abelhamid Ibrahim, Al-Khobar (SA)" to "Abdelhamid Ibrahim El Metwaly, Ruwi (OM)"

Signed and Sealed this
Twenty-sixth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,316,938 B2
APPLICATION NO. : 12/448889
DATED : November 27, 2012
INVENTOR(S) : Al-Jarri It is certified that error appears in the above-identified patent and that said Letters Patent is hereby corrected as shown below:

Title Page, Item (75) Inventors:
For the third inventor, correct "Elmetwaly Abelhamid Ibrahim, Al-Khobar (SA)" to
-- Abdelhamid Ibrahim El Metwaly, Ruwi (OM) --

This certificate supersedes the Certificate of Correction issued February 26, 2013.

Signed and Sealed this
Nineteenth Day of March, 2013

Teresa Stanek Rea
*Acting Director of the United States Patent and Trademark Office*